US005782727A

United States Patent [19]

Pierce

[11] Patent Number: 5,782,727

[45] Date of Patent: Jul. 21, 1998

[54] TRAINING DEVICE FOR KICKING

[76] Inventor: Maynard H. Pierce, 4856 High Forest Dr., Duluth, Ga. 30136

[21] Appl. No.: 797,399

[22] Filed: Feb. 10, 1997

[51] Int. Cl.[6] ..... A63B 69/00

[52] U.S. Cl. ..... 482/129; 482/121; 482/124

[58] Field of Search ..... 482/129, 121, 482/124; 36/128, 132; 602/65

[56] References Cited

U.S. PATENT DOCUMENTS

| | | | |
|---|---|---|---|
| 2,848,234 | 8/1958 | Brandon | 482/129 |
| 3,306,610 | 2/1967 | Biggs, Jr. et al. | 482/129 |
| 4,042,241 | 8/1977 | Collins . | |
| 4,071,241 | 1/1978 | Cortes Garcia . | |
| 4,121,822 | 10/1978 | DiSabatina et al. . | |
| 4,121,829 | 10/1978 | Petrusek . | |
| 4,325,548 | 4/1982 | Piccini | 482/129 |
| 4,687,209 | 8/1987 | Carey . | |
| 5,094,462 | 3/1992 | Boyle et al. . | |
| 5,203,754 | 4/1993 | Maclean | 482/124 |
| 5,358,258 | 10/1994 | Killion . | |
| 5,443,576 | 8/1995 | Hauter . | |
| 5,599,260 | 2/1997 | Rovinsky et al. | 482/124 |
| 5,624,360 | 4/1997 | Wilkins | 482/129 |

FOREIGN PATENT DOCUMENTS

| | | | |
|---|---|---|---|
| 1611353 | 12/1990 | U.S.S.R. | 482/124 |

*Primary Examiner*—Jerame Donnelly
*Attorney, Agent, or Firm*—Hinkle & Associates, P.C.

[57] ABSTRACT

A training device (10) that is suitable for practicing the kicking stroke for punting and/or soccer style field goal kicking, comprising a harness (12) that fits over an ordinary cleat (14). A ring positioning strap (34) attaches to the harness (12) and accepts a D-shaped cord attachment ring (40) at predetermined loop positions along the periphery of the harness (12). A cord (58) attaches to the ring (40) at one end and attaches to a fixed object such as a corkscrew type anchor (56) at the other end. The training device (10) provides a smooth, variable resistance to the leg as the leg is extended during the punting or kicking motion.

7 Claims, 2 Drawing Sheets

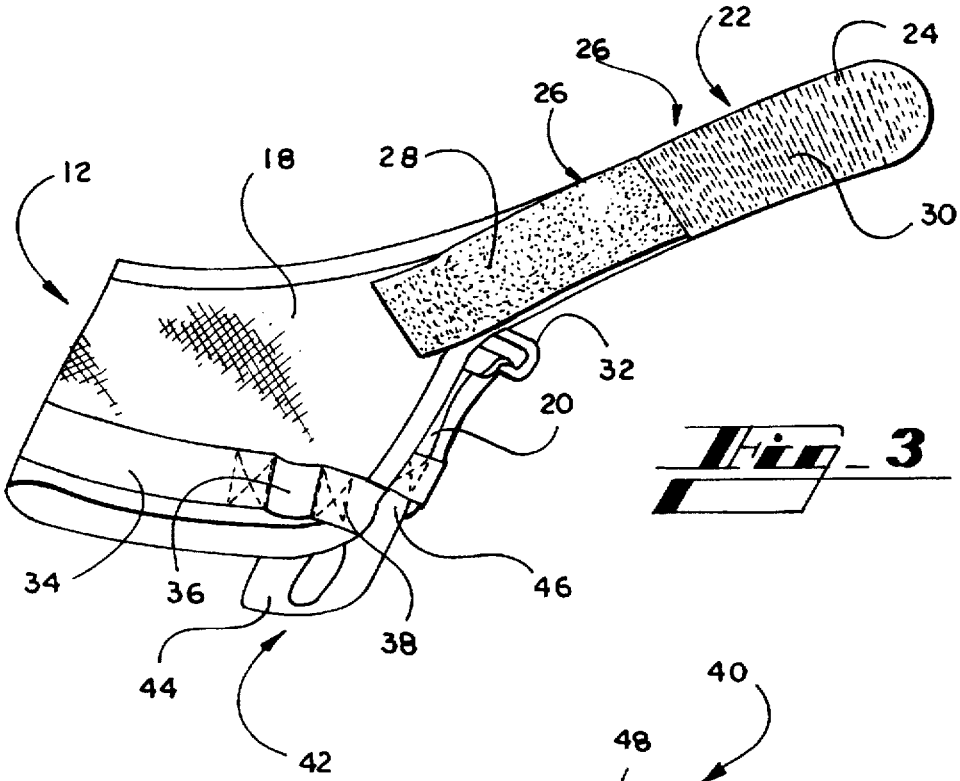
Fig. 3
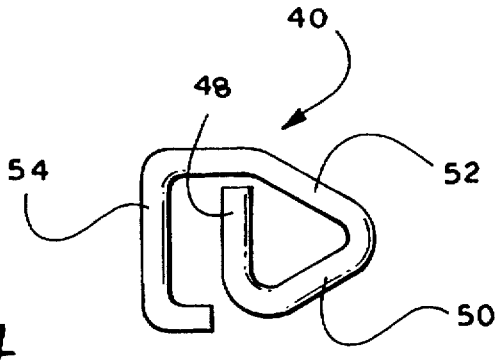
Fig. 4
Fig. 5
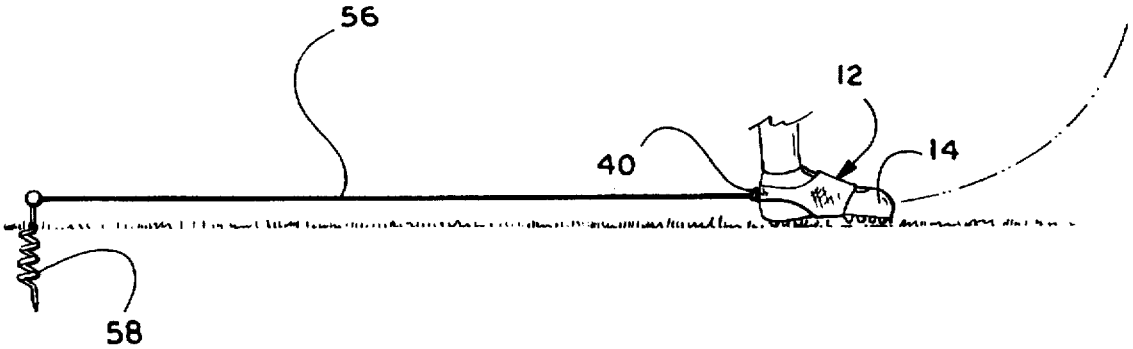

TRAINING DEVICE FOR KICKING

BACKGROUND OF THE INVENTION

I. Field of the Invention

The present invention relates to training devices, and more particularly to a resistance training device for punting and kicking a football.

II. Description of the Related Art

It has been known in the prior art to attach cords made of elastic material to various parts of the body for training purposes. In the field of soccer training devices there have been many inventions that attach a cord with a ball on the end of it to the body. U.S. Pat. No. 4,042,241 discloses a device that attaches a cord to the foot and ankle at one end and to a soccer ball at the other end. The device utilizes an elastic cord that wraps around the ankle and the arch of the foot. The device enables the user to kick the ball away from their body and to have the ball return automatically.

The use of elastic cords for resistance training exercises is well known in track and field. The cords attach to various parts of the body including the feet, ankles, arms, and waist depending on the particular exercises to be done. In order to attach the cords to the body, harnesses with clips are commonly used.

None of the existing resistance devices are suitable for use by a punter or soccer style field goal kicker in practicing their actual kicking stroke. None of the existing devices for kicking utilize an easily attachable and removable harness that can be used with most types and sizes of shoes.

At advanced levels of football, the importance of hang time for a punted football becomes paramount. Hang time is the amount of time that elapses from the time that the ball is punted until the time that the ball is caught or strikes the ground. Without sufficient hang time, defending a punt return becomes a difficult task because the punt returner is allowed time to catch the ball on the run and go up the field before the opposing team can get down the field. The initial angle of trajectory of the football is a key factor in determining the amount of hang time that is possible for a given amount of kicking force. Accordingly, the height of the punter's leg at the instant of impact is significant in determining the amount of hang time that is possible for a given kick. Thus, there is a need for a device that provides resistance training for the kicking stroke used in punting a football. The results of persistent exercise of the kicking stroke can be increased leg strength and flexibility, with the effect of the kicker imparting greater height and distance to the kicked ball.

SUMMARY OF THE INVENTION

The present invention provides a training device for punting or kicking a football. Generally described, the present invention provides an adjustable harness that fits over many different types and sizes of shoes or cleats. The harness connects to an elastic cord by means of a fixed ring. The elastic cord provides a smooth, variable resistance to the leg as the leg is extended during the punting motion.

In a preferred embodiment, the present invention provides a flexible harness having a back section, a first side section, and a second side section. The harness fits over a standard shoe or cleat. A connecting strap extending from the first side section fits through a ring that is connected to the second side section. The connecting strap has hook and loop fastening means affixed thereto such that when the strap is threaded through the ring and folded back onto itself, the hook and loop fastening means are held together and the harness fits snugly over the shoe.

A U-shaped member extends from the first side section to the second side section of the harness. In use, the member crosses underneath the arch of the foot to provide additional support to the harness.

A ring connecting strap extends along the periphery of the harness and provides loops for attachment of a D-shaped ring. The loops are positioned at predetermined points along the harness according to the type of kicking stroke to be practiced. One of the loops is positioned at the heel of the shoe for practicing punting. The other loops are positioned at the sides of the shoe for practicing soccer style kicking.

The D-shaped ring has three legs and a C-shaped extension. The three legs form a D-shape which provides the connection point for the elastic cord. The C-shaped extension is shaped to fit inside the loops on the ring connecting strap without sliding off of the loops.

The end of the cord opposite the shoe may be attached to any fixed point. However, for practicing on a football field, a corkscrew type anchor that screws into the ground is preferred.

It is an object of the present invention to provide a training device for punting a football.

It is also an object of the present invention to provide a resistance training device that attaches to the outside of a pair of shoes.

It is another object of the present invention to provide an adjustable harness for attaching to the outside of shoes of varying sizes.

It is an additional object of the present invention to provide a device for use on an outdoor football field for the practice of punting.

It is yet an additional object of the present invention to provide a resistance training device to maximize the height of a punter's leg upon impact with a football.

It is a further object of the present invention to provide a resistance training device that is adjustable between predetermined positions along the periphery of the harness.

It is yet a further object of the present invention to provide a training device for kicking that is lightweight and inexpensive to manufacture.

Another object of the present invention is to provide a training device for kicking that provides for easy adjustment of the resistance of the device.

An additional object of the present invention is to provide an easily detachable harness that fits on a variety of sizes and types of shoes.

A further object of the present invention is to provide a harness that attaches to an elastic cord for practicing punting.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which:

FIG. 3 is a side view of the present invention;

FIG. 4 is a plan view of the D-shaped ring of the present invention; and

FIG. 5 is a schematic view of the present invention.

DESCRIPTION OF THE PREFERRED EMBODIMENTS

Figure 1:
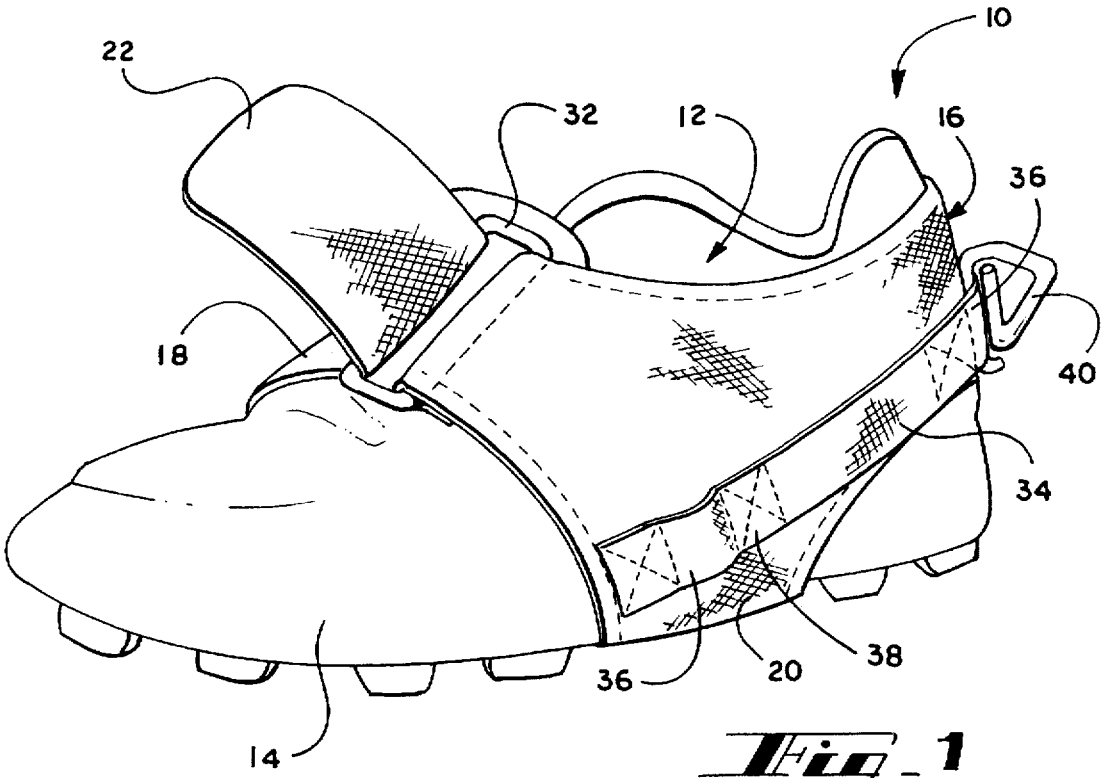
FIG. 1 is a perspective view of the device of the present invention mounted on a shoe with the connecting strap threaded through the fixed ring, but not attached by the hook and loop fastening means.

Referring to FIGS. 1–5 generally, and particularly to FIG. 1, a training device 10 comprises a harness 12 that covers an ordinary cleat 14. The harness 12 is preferably constructed of a lightweight, durable material such as nylon, polyester or other fabric. The harness 12 has three sections: a back section 16, a first side section 18, and a second side section 20. A connecting strap 22 extends from the first side section 18. The connecting strap 22 is approximately five inches long and two inches wide. As shown in FIG. 3, the outside surface 24 of the strap 22 has hook and loop fastening means 26 attached thereto. The hook portion 28 is located adjacent to the first side section 18 and the loop portion 30 is located on the opposite end of the connecting strap 22.

Returning to FIG. 1, a fixed ring 32 attaches to the second side section 20 of the harness 12. The fixed ring 32 may be constructed out of plastic or metal or other suitable rigid material. The fixed ring 32 is attached to the second side section 20 by sewing the end of the side section to the ring 32, and is wide enough for the connecting strap 22 to fit therethrough. The ring 32 is longitudinal in overall shape. In order to wrap the harness 12 around the shoe 14, the back section 16 and the side sections 18 and 20 are wrapped around the shoe 14, and the connecting strap 22 is inserted through the fixed ring 32. Once the connecting strap 22 is inserted through the ring 32, the strap 22 is folded back over the ring and the hook and loop fastening means 26 is attached on the outside of the strap 22.

Figure 2:
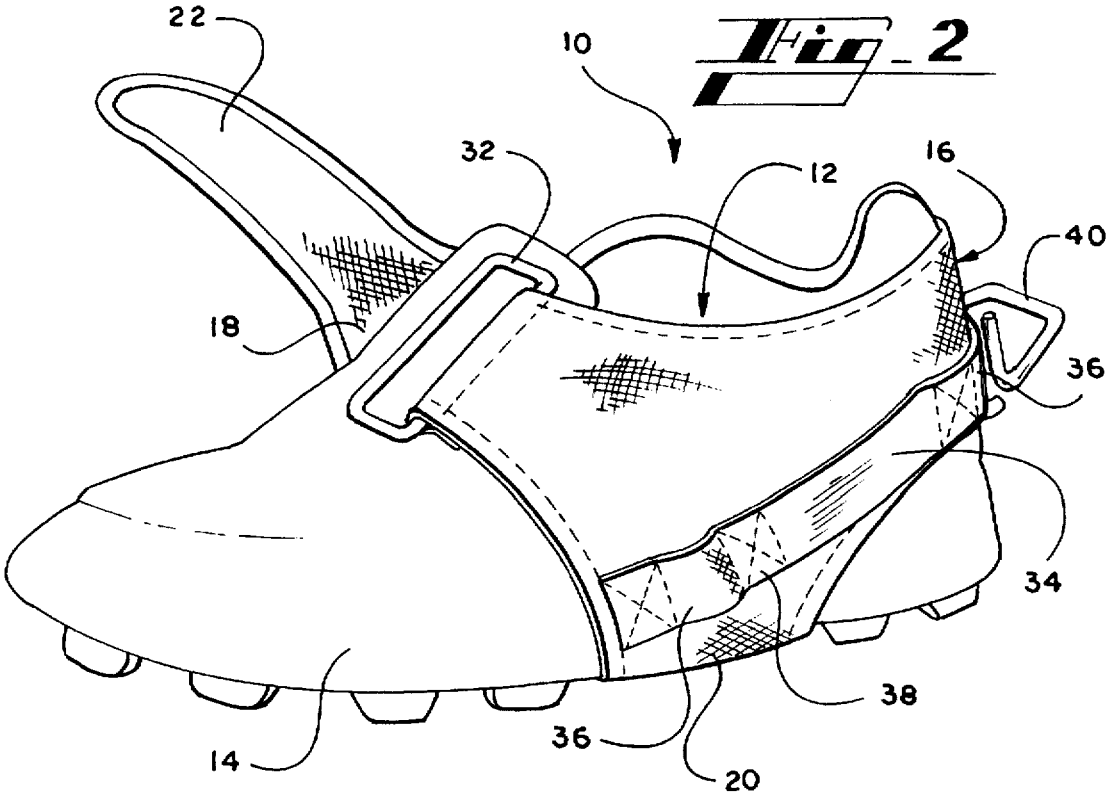
FIG. 2 is a perspective view of the present invention in the open position mounted on a shoe.

Turning to FIG. 2, the training device 10 of the present invention is shown in the open position. A ring positioning strap 34 is attached to the second side section 20 of the harness. This strap 34 is preferably constructed of a durable, lightweight material such as nylon. The strap 34 is preferably sewn to the side section 20, although alternative ways of attaching the strap such as gluing may be substituted. Loops 36 are formed between stitching 38 that secures the strap 34. A cord attachment ring 40 fits inside the loops 36 formed in the ring positioning strap 34. The loops 36 are located at predetermined positions along the periphery of the harness 12. One of the loops 36 is positioned on the back section 16 for practicing the punting stroke. The other loops 36 are positioned on the side sections 18 and 20 for practicing left or right footed soccer style field goal kicking.

Referring to FIG. 3, a U-shaped member 42 extends from side section 18 to side section 20 underneath the harness 12. A first end 44 of the U-shaped member 42 attaches to the first side section 18, and a second end 46 of the U-shaped member 42 attaches to the second side section 20. When the harness 12 is attached to the cleat 14, the U-shaped member 42 fits under the cleat 14 through the arch of the cleat 14.

FIG. 4 shows a detail of the cord attachment ring 40 which has a first leg 48, a second leg 50, a third leg 52, and an extension 54. The cord attachment ring 40 is preferably formed out of metal for durability, however, a plastic ring may be suitable. Legs 48, 50, and 52 form a D-shape which is open at one corner. The extension 54 extends beyond the open corner and forms a C-shape. The C-shape of the extension 54 enables the ring 40 to fit on the loops 36 without sliding off during use (as shown in FIGS. 1 and 2). Preventing the ring 40 from inadvertently sliding off of the loops 36 is important because a sudden change of resistance could cause the user to lose their balance.

Turning to FIG. 5, a cord 56 made of an elastic material is attached at one end to the cord attachment ring 40 on the harness 12 and to a fixed point at the other end of the cord 56. For use on athletic fields, a cork-screw type anchor 58 is preferable. However, any sufficiently stable method of attaching the cord 56 to a fixed object would be suitable. The cord 56 is preferably constructed of nylon or any other strong elastic material. In order to change the resistance of the device, a new cord is simply substituted for cord 56.

Accordingly, the training device of the present invention offers advantages over the prior art devices by providing a simple device for training of the leg for kicking and especially for the punting stroke. The present invention is easily attachable to and removable from an ordinary shoe, and is particularly well suited for punting a football.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A training device for kicking, the training device to be used in connection with an ordinary shoe, the training device comprising:

a harness having a back section, a first side section the first side section removably attaching to the second side section; and a second side section;

a fixed ring connected to the second side section adjacent to the connecting strap;

a U-shaped member having a first end and a second end, the first end connected to the first side section of the harness and the second end connected to the second side section of the harness;

a D-shaped cord attachment ring having a first leg, a second leg, a third leg and a C-shaped extension, the first leg connected to the second leg, the second leg connected to the third leg, and the third leg connected to the extension;

a ring positioning strap attached to the harness, the strap having at least one loop for insertion of the C-shaped extension of the D-shaped ring, the at least one loop being located at a predetermined position along the harness; and an elastic cord attached at one end to the cord attachment ring and at the other end to a fixed object.

2. The training device of claim 1, wherein the fixed object is a corkscrew anchor.

3. The training device of claim 1, wherein the harness is adjustable.

4. The training device of claim 1, wherein the cord attachment ring is attached to the back section of the harness.

5. The training device of claim 1, wherein the cord attachment ring is attached to the first side section of the harness.

6. The training device of claim 1, wherein the cord attachment ring is attached to the second side section of the harness.

7. The training device of claim 1, wherein the first side section attaches to the second side section by hook and loop fastening means.

* * * * *